US011348469B2

(12) United States Patent
Manberg et al.

(10) Patent No.: US 11,348,469 B2
(45) Date of Patent: May 31, 2022

(54) SYSTEMS AND METHODS FOR PROVIDING WAKE SITUATIONAL AWARENESS DISPLAYS

(71) Applicant: AVIATION COMMUNICATION & SURVEILLANCE SYSTEMS, LLC, Phoenix, AZ (US)

(72) Inventors: Charles Castel Manberg, Phoenix, AZ (US); Richard Darrell Ridenour, Peoria, AZ (US)

(73) Assignee: AVIATION COMMUNICATION & SURVEILLANCE SYSTEMS, LLC, Phoenix, AZ (US)

( * ) Notice: Subject to any disclaimer, the term of this patent is extended or adjusted under 35 U.S.C. 154(b) by 89 days.

(21) Appl. No.: 16/583,063

(22) Filed: Sep. 25, 2019

(65) Prior Publication Data

US 2020/0098272 A1 Mar. 26, 2020

Related U.S. Application Data

(60) Provisional application No. 62/736,105, filed on Sep. 25, 2018.

(51) Int. Cl.
*G08G 5/00* (2006.01)

(52) U.S. Cl.
CPC ..... *G08G 5/0021* (2013.01); *G08G 5/0008* (2013.01)

(58) Field of Classification Search
CPC .. G01S 1/00; G01W 1/00; G08G 5/00; G08G 5/0004; G08G 5/0008; G08G 5/0021; G08G 5/0052; G08G 5/0065; G08G 5/0078; G08G 5/02; G08G 5/025; G05D 1/02; G05D 1/104; B64D 45/00
See application file for complete search history.

(56) References Cited

U.S. PATENT DOCUMENTS 6,433,729 B1 * 8/2002 Staggs ..... G01S 7/12 342/29
7,636,635 B2 * 12/2009 Winkler ..... G05D 1/104 244/158.1
8,000,848 B2 8/2011 Faprid et al.
8,742,973 B1 * 6/2014 Fersdahl ..... G01S 7/411 342/26 B (Continued)

FOREIGN PATENT DOCUMENTS

FR 3041121 A1 3/2017

OTHER PUBLICATIONS

NPL Search (Jan. 12, 2022).*

(Continued)

*Primary Examiner* — Van T Trieu
(74) *Attorney, Agent, or Firm* — Dickinson Wright PLLC

(57) ABSTRACT

There are provided systems and methods for enhancing wake turbulence situational awareness in the cockpit of an aircraft. In one aspect, transmissions from a lead aircraft are received and stored by a trailing aircraft to allow the trailing aircraft to create a history of the lead aircraft's position for the purposes of, among other things, determining the relative positioning of the lead and the trailing aircraft (or trailing aircraft's) flight paths and relative altitudes. From this determination, better situational information can be displayed to the flight crew to aid in wake turbulence avoidance.

35 Claims, 8 Drawing Sheets

(56) References Cited

U.S. PATENT DOCUMENTS

| | | | | |
|---|---|---|---|---|
| 9,709,698 | B2 | 7/2017 | Nykl et al. | |
| 9,911,342 | B2 | 3/2018 | Herder | |
| 2002/0075171 | A1 | 6/2002 | Kuntman et al. | |
| 2003/0222795 | A1 | 12/2003 | Holforty et al. | |
| 2014/0136110 | A1* | 5/2014 | Nykl | G08G 5/0078 702/3 |
| 2016/0063866 | A1* | 3/2016 | Trefilova | G08G 5/0078 340/971 |
| 2016/0328981 | A1 | 11/2016 | Herder | |

OTHER PUBLICATIONS

International Search Report and Written Opinion in PCT Application No. PCT/US2019/053031, dated Dec. 19, 2019, (14 pages) Issued by the European Patent Office / International Searching Authority.

* cited by examiner

SYSTEMS AND METHODS FOR PROVIDING WAKE SITUATIONAL AWARENESS DISPLAYS

CROSS REFERENCE TO RELATED APPLICATIONS

This application claims the full benefit of and priority to U.S. provisional patent application No. 62/736,105 filed Sep. 25, 2018 titled, "SYSTEMS AND METHODS FOR PROVIDING WAKE SITUATIONAL AWARENESS DISPLAYS," the disclosure of which is fully incorporated herein by reference for all purposes.

FIELD AND BACKGROUND OF THE INVENTION

Field of the Invention

The present invention relates to an aircraft avionic system and method, and in particular, to a system and method for determining wake turbulence hazards, and more particularly, displaying potential wake turbulence hazard information to a flight crew to aid in avoidance of wake turbulence.

Background of the Invention

Wake turbulence is a known aviation hazard that arises from aircraft creating persistent disturbances in air from the passage of the aircraft and the interaction of aircraft surfaces with surrounding air. Wake turbulence is a function of an aircraft producing lift, resulting in the formation of two counter-rotating vortices trailing behind the aircraft—FIG. 1 illustrates such an aircraft 150, with generated wake vortices 10, 11. However, the vortex strength from an aircraft increases proportionately to an increase in operating weight or a decrease in aircraft speed. Since the turbulence from a "dirty" aircraft configuration hastens wake decay, the greatest vortex strength occurs when the generating aircraft is heavy, clean (that is, not deploying flaps or air brakes and thus not "dirty") and flying slowly. As FIG. 2 illustrates, an aircraft may generate wake vortices 10, 11, from the moment they rotate on takeoff to touchdown. Also, as FIG. 3 illustrates wake vortexes may persist from one to three minutes after they are generated, and generally sink in a downward direction by several hundred feet per minute (commonly, about 300-500 feet per minute, but may be subject to sheer force winds and other conditions that change their direction). Aircraft following the generating aircraft that enter an air vortex may be subject to significant roll forces, loss of control, and airframe stresses, and numerous cases of aircraft accidents initiated or exacerbated by wake vortexes have been recorded.

Avoidance of wake vortexes is accomplished by pilots being aware of any aircraft in their vicinity, whether in an in-trail situation or on take-off or landing, and through following spacing, separation, and timing guidelines to avoid encounters with wake vortexes generated by a lead aircraft or an aircraft that has crossed the flight pattern of the trailing aircraft (example avoidance areas are illustrated at 13 in FIGS. 2 and 3). Pilots of trailing aircraft are generally instructed to fly at or above the lead aircraft's flight path, altering course as necessary to avoid the area directly behind and below the lead/generating aircraft. Put another way, pilots attempt to estimate where the lead aircraft's position would have been at their (that is, the trailing aircraft's) position and maintaining a flight level above that altitude, for instance 1000 feet above the lead aircraft's former altitude at the trailing aircraft's current position. One can understand how making this determination can be problematic. Additionally, wake vortex and lead aircraft flight trail determination often requires visual awareness, detection, and planning by the cockpit crew, and in busy airspaces, especially when aircrew is taxed with multiple procedures in proximity to airports, human error may lead to unwanted wake vortex encounters. Further, it is often challenging for a pilot to visually estimate the distance of another aircraft and/or the time it may take to reach the flight path of that aircraft and any accompanying potential wake turbulence. Additionally, if the lead/generating aircraft is climbing or descending rapidly (for example, greater than 1000 feet per minute), then a significant wake vortex may persist across several flight levels. If the lead aircraft is descending, this means that a wake vortex event can occur above the position of the lead aircraft at the time of the encounter. The greater longevity of vortices at higher cruise altitudes can lead to encounters at much greater in track separation than ATC separation minima if the prevailing wind speeds are low. Further, while a cross-track encounter in flight may produce a few notable 'jolts' as the vortices are crossed, injuries to unsecured occupants can result, both passengers and cabin crew. The multiple factors required to estimate wake vortex position as well as visibility and pilot tasking increase the difficulty in safely navigating these hazardous events. As a result of estimation inaccuracy, it is possible for the pilot to encounter a wake turbulence even when the pilot estimates that the aircraft is sufficiently spaced from another aircraft. Further, arbitrarily increasing space between lead/trailing aircraft may help to reduce wake vortex events at the expense of decreasing airspace throughput and traffic management efficacy.

What is needed is a system to enhance wake situational awareness, allowing cockpit crew to receive more timely information about wake hazards and to assist crew in avoidance with wake turbulence.

SUMMARY OF THE INVENTION

The following technical disclosure is exemplary and explanatory only and is not necessarily restrictive of the invention as claimed.

Embodiments of the present invention provide methods of using data that may be transmitted by a lead aircraft to allow one or more trailing aircraft to receive the data and create a history of the lead aircraft's position for the purposes of, among other things, determining the relative positioning of the lead and the trailing aircraft (or trailing aircraft's) flight paths. From this determination, better situational information can be displayed to the flight crew to aid in wake turbulence avoidance.

One example of wake situational awareness information that may be provided in a flight deck may provide the difference in altitude between a current trailing aircraft's position and the position history of a lead aircraft. As discussed in more detail below, the altitude difference may be presented on the flight deck display to provide the pilot of the trailing aircraft awareness of his aircraft's position relative to the lead aircraft's flight path.

A method of the present invention comprises receiving, by a trailing aircraft, a plurality of flight information transmissions from a lead aircraft; creating, from the plurality of flight information transmissions, a positional history of the lead aircraft; determining from the positional history and the plurality of flight information transmissions, a differential flight parameter proximate a current position of the trailing aircraft; and presenting on a display in a cockpit of the trailing aircraft an indicia of the current position of the trailing aircraft, an indicia of the leading aircraft relative to the trailing aircraft, and the differential flight parameter for the trailing aircraft. The flight information transmissions may comprise any desired information, and in various embodiments, may comprise one or more of a location of the lead aircraft; identifying information of the lead aircraft; an altitude of the lead aircraft; weight information of the lead aircraft; airspeed information of the lead aircraft; a time value when the flight information transmission was transmitted; heading information of the lead aircraft; control surface configuration information of the lead aircraft; a rate of climb or descent of the lead aircraft; weather information proximate to the lead aircraft; and weight-based class of the lead aircraft. The weight information of the lead aircraft may comprised FAA or industry standard categories such as one of: Super, Heavy, B757, Large, Small+, and Small. In various embodiments, positional history of the lead aircraft may be is restricted to a predetermined time window, or for a span of time representing a predetermined distance traveled by the lead aircraft. In a further embodiment, the differential flight parameter may further comprise one of a flight path of the lead aircraft, relative flight path of the trailing aircraft, heading, distance between the lead aircraft and the trailing aircraft, ground speed of the lead aircraft, difference in ground speed between the lead aircraft and the trailing aircraft.

In one aspect, determining a differential flight parameter from the positional history and the plurality of flight information transmissions may further comprise analyzing the positional history to determine a closest previous location of the lead aircraft based upon minimum distance to the current position of the trailing aircraft; and computing the differential flight parameter from a difference between an altitude of the lead aircraft at the closest previous location and a current altitude of the trailing aircraft, and in various embodiments, may further include determining whether the differential flight parameter is less than a minimum altitude separation distance, which in one embodiment can be one of 1000 feet or 800 feet, and in another embodiment, can be in the range of 10 feet to 100 feet. Additionally, an embodiment further comprises computing the differential flight parameter based upon computing a wake clearance margin utilizing the weight information of the lead aircraft; the airspeed information of the lead aircraft; and an elapsed time from the time the closest previous location of the lead aircraft was transmitted to a current time. Another embodiment further comprises computing the differential flight parameter based upon computing a wake clearance margin utilizing the weight information of the lead aircraft; the airspeed information of the lead aircraft; and an extrapolated flight time to a current position of the lead aircraft. Yet another embodiment further comprises computing the differential flight parameter based upon computing a wake clearance margin utilizing the weight information of the lead aircraft; the airspeed information of the lead aircraft; and an expected sink rate of wake vortices generated by the lead aircraft. A further embodiment further comprises computing the differential flight parameter based upon computing a wake clearance margin utilizing the weight information of the lead aircraft; the airspeed information of the lead aircraft; and a wind speed value and wind direction value proximate to the trailing aircraft; and an elapsed time from the time the closest previous location of the lead aircraft was transmitted to a current time.

The Flight information transmissions may be formatted to any desired transmission protocol, and in various embodiments, may comprise ADS-B transmissions, or may comprise messages overlaid onto an ATC signal via phase enhancement.

Once information is processed and computed, it may be presented on a display or broadcast over a speaker in a cockpit of the trailing aircraft to enhance wake situational awareness. In various embodiments, there may be presented on a display in the trailing cockpit at least one of a location of the lead aircraft relative to the trailing aircraft; a difference in altitude between a current position of the trailing aircraft and a closest position of the lead aircraft obtained from the flight information transmissions; time and distance to the lead aircraft; a differential flight parameter; a flight path of the lead aircraft relative to a flight path of the trailing aircraft; an alert for a potential wake turbulence event; a guidance path for the trailing aircraft to avoid wake turbulence from the lead aircraft; identifying information of the lead aircraft; an altitude of the lead aircraft; weight information of the lead aircraft; airspeed information of the lead aircraft; a time value when the flight information transmission was transmitted; heading information of the lead aircraft; control surface configuration information of the lead aircraft; a rate of climb or descent of the lead aircraft; and weight-based class of the lead aircraft.

Various embodiments of the present invention provide for the situation where multiple aircraft may be generating wake vortices ahead of the trailing aircraft; in this scenario, multiple threat aircraft are considered for advisement of wake turbulence conditions. One aspect comprises identifying a plurality of threat aircraft; computing a respective differential flight parameter for each of the threat aircraft; and rendering on the display an indicia of each of the plurality of threat aircraft relative to the position of the trailing aircraft, and associated with each of the respective indicia, the respective differential flight parameter. Also, in one aspect, in a cockpit of the trailing aircraft, an aural announcement may be generated that the trailing aircraft is at risk of encountering a wake turbulence event from the lead aircraft.

A system of the present invention may comprise, in a trailing aircraft, a processor electrically coupled to a memory, a transceiver electrically coupled to the processor; an output device in the cockpit of the trailing aircraft including a display electrically coupled to the processor; a position measuring device coupled to the processor; and an antenna coupled to the transceiver; whereby the memory is configured to store code that when executed by the processor, performs the steps of: receiving, by the transceiver, a plurality of flight information transmissions from a lead aircraft and storing the transmissions in the memory; creating, from the plurality of flight information transmissions, a positional history of the lead aircraft, and storing the positional history of the lead aircraft in the memory; determining from the positional history and the plurality of flight information transmissions, a differential flight parameter proximate a current position of the trailing aircraft; and presenting on the display an indicia of the current position of the trailing aircraft, an indicia of the leading aircraft relative to the trailing aircraft, and the differential flight parameter for the trailing aircraft. Furthermore, any of the methods of the present invention set forth above may be executed by the disclosed system, in any order desired to meet the desired conditions.

BRIEF DESCRIPTION OF THE DRAWINGS

A more complete understanding of the present invention may be derived by referring to the detailed description and claims when considered in connection with the following illustrative figures.

DETAILED DESCRIPTION

Figure 1:
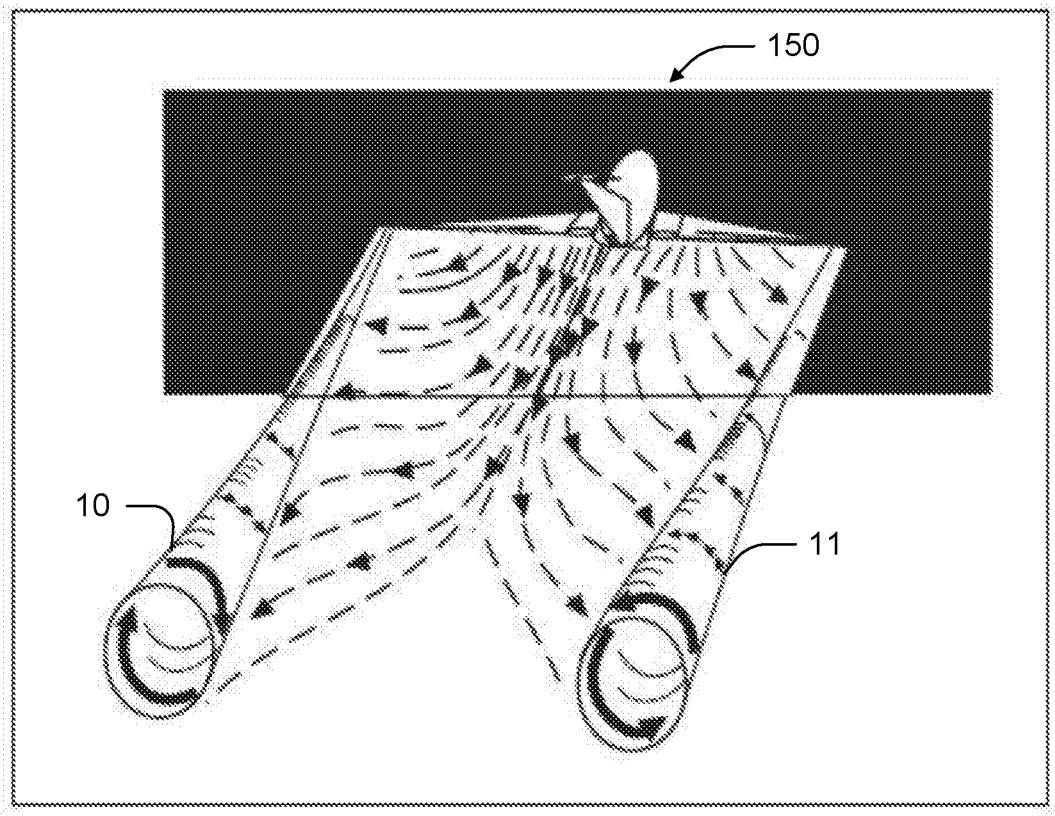
FIG. 1 illustrates a perspective view of a lead aircraft generating wake vortices.
Figure 2:
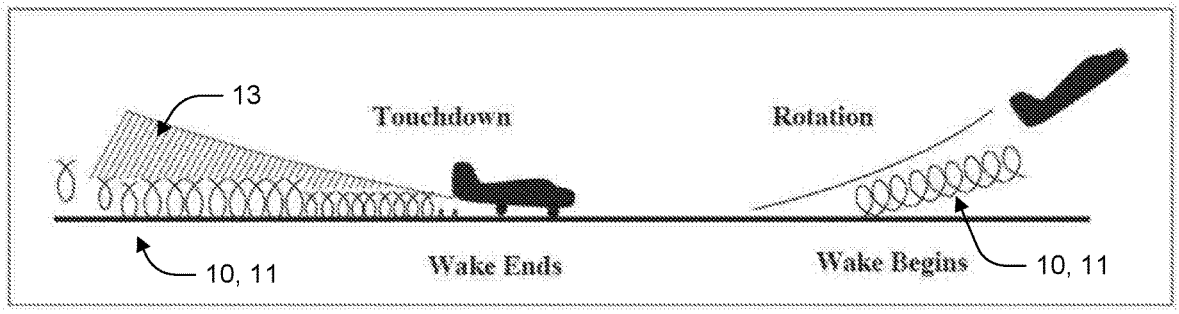
FIG. 2 shows a side view of landing and takeoff/rotation scenarios where wake vortices may be generated.
Figure 3:
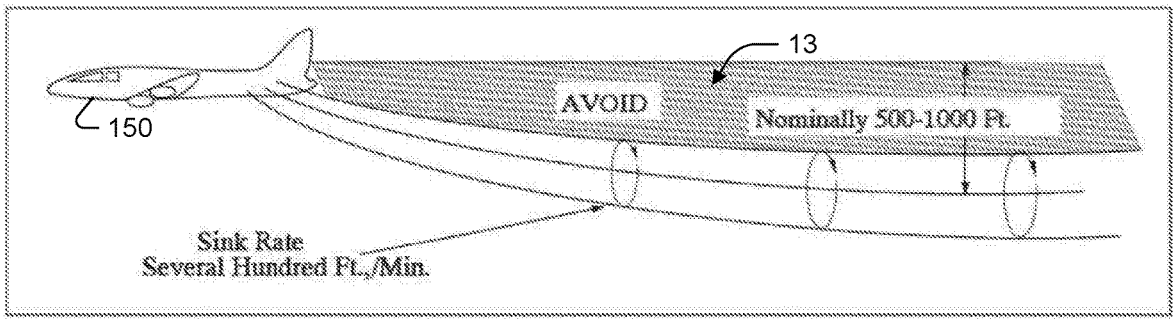
FIG. 3 shows a side view of how wake vortices, once generated by a lead aircraft, tend to sink and persist.
Figure 4:
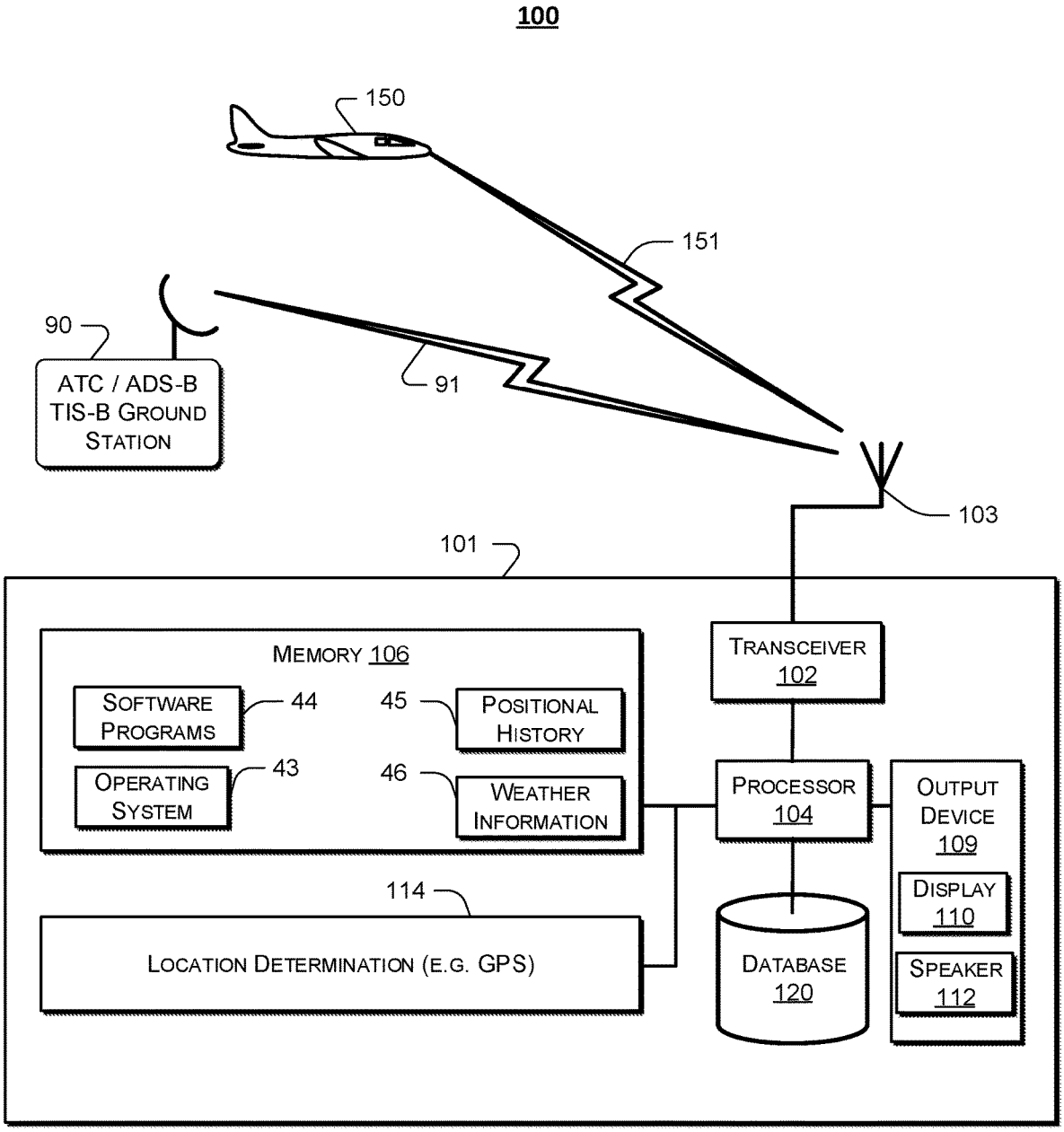
FIG. 4 illustrates a block diagram of a system of the present invention.

FIG. 4 illustrates an embodiment of a block diagram of the present invention. Lead aircraft 150 generates flight information transmissions, 151 that are received by the antenna 103 of the trailing aircraft's tracking and display system 101. Antenna 103 may also receive transmissions 91 from a ground station 90 that provides surveillance information, weather information, or other flight information transmission data regarding the lead aircraft 150. The flight information transmissions may contain a variety of information, such as identifying information of the lead aircraft; a location of the lead aircraft; an altitude of the lead aircraft (which also may be provided by the location of the lead aircraft or may be separately provided); weight information of the lead aircraft; airspeed information of the lead aircraft; a time value when the flight information transmission was transmitted; heading information of the lead aircraft; control surface configuration information of the lead aircraft; a rate of climb or descent of the lead aircraft; weather information proximate to the lead aircraft; and weight-based class of the lead aircraft. The flight information transmissions may be provided from protocols such as ADS-B transmissions, or ATC signals that are overlaid with information via phase enhancement.

Phase Enhancement, sometimes alternatively referred to as "ATC-Data Overlay" or Phase Modulation, is a term referencing technology variously described in the following patent applications and patents, hereby incorporated herein by reference: Appl. No. 60/926,126, filed Apr. 24, 2007; Application Ser. No. 12/105,248, filed Apr. 17, 2008; Appl. No. 60/931,274, filed May 21, 2007; Appl. No. 61/054,029, filed May 16, 2008; Appl. No. 61/059,736, filed Jun. 6, 2008; Appl. No. 61/060,385, filed Jun. 10, 2008; Appl. No. 61/163,747, filed Mar. 26, 2009; Appl. No. 61/176,046, filed May 6, 2009; application Ser. No. 12/467,997, filed May 18, 2009 (now U.S. Pat. No. 8,344,936); application Ser. No. 12/482,431, filed Jun. 10, 2009 (now U.S. Pat. No. 8,031,105); application Ser. No. 12/455,886, filed Jun. 8, 2009; Appl. No. 61/253,981, filed Oct. 22, 2009; applicaton Ser. No. 12/748,351, filed Mar. 26, 2010; application Ser. No. 12/775,321, filed May 6, 2010; application Ser. No. 12/910,642, filed Oct. 22, 2010; Appl. No. 61/845,864, filed Jul. 12, 2013 and application Ser. No. 14/331,089, filed Jul. 14, 2014. Further to the techniques described in the identified patents and patent applications, in various embodiments of the present invention, flight information transmissions may be overlaid onto existing ATC signals by a lead aircraft 150 or a ground station 90, and a transceiver 102 of the trailing aircraft may demodulate and extract flight information transmission data independently from the received ATC information encoded into the received signals 91, 151. Thus, in various embodiments, phase enhancements may be utilized to relay information that may or may not be otherwise included in a received ATC-formatted signal, without requiring additional bandwidth to do so.

An embodiment of the present invention also includes a processor 104 electrically coupled to a memory 106, a transceiver 102 electrically coupled to the processor 104; an output device 109, in the cockpit of the trailing aircraft including a display 110 and speaker 112 electrically coupled to the processor 104, an optional database 120 electrically coupled to the processor 104; and a location determination device, for example a GPS device 114, electrically coupled to the processor 104. The memory 106 may contain a variety of data, such as software programs 44 that may be used in execution of embodiments of the present invention, an operating system 43, positional history data 45 that stores prior positions of a lead aircraft, and weather information 46 that may be proximate to the lead aircraft, to the trailing aircraft, or at any position proximate to a flight path of either aircraft. The optional database 120 may store any desired information, and may be further configured to store any of the information within the memory 106, performance information about lead aircraft types, weather information, maps and terrain information, or any other desired data that may be utilized by embodiments of the present invention. While preferred embodiments of the present invention utilize received signals 91, 151, additional embodiments of the present invention may transmit information to the lead aircraft 150 or the ground station 90 to further increase accuracy or to coordinate avoidance of wake events.

Figure 5:
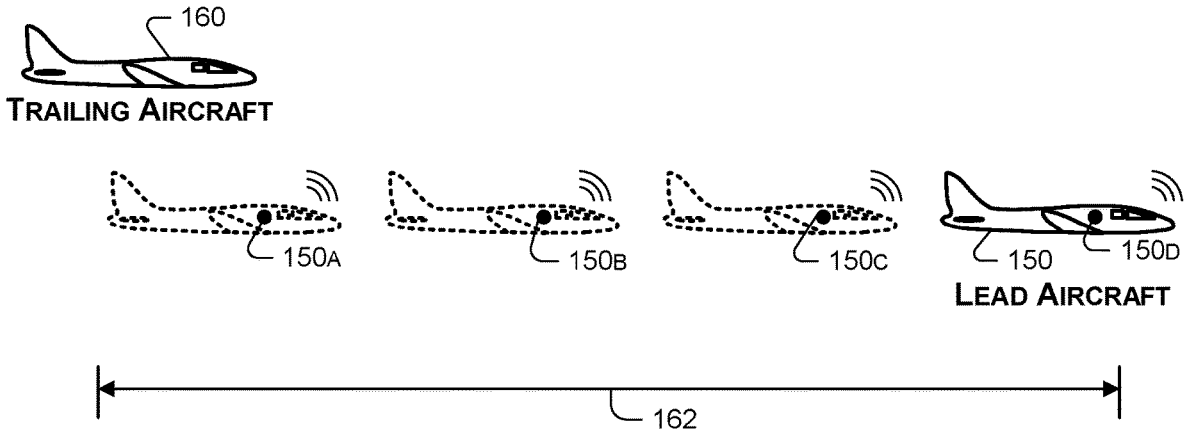
FIG. 5 illustrates a side view of one aspect of lead aircraft position gathering of the present invention.

FIG. 5 shows a side view of two aircraft, a leading aircraft 150, and a trailing aircraft 160, and further illustrates a summary approach to an embodiment of the present invention. Lead aircraft 150 provides a series of transmissions over time (shown by previous locations of the lead aircraft at locations 150A, 150B, 160C, and the current location of the lead aircraft 150D). Transmissions are indicated by the arcuate radiation patterns by each of the lead aircraft locations 150A-150D, and as explained above, may comprise ADS-B transmissions or an ATC data overlay signal transmissions. The trailing aircraft receives each of the transmissions respectively transmitted from locations 150A-150D, decodes the information from the plurality of transmissions, and stores the information to create a positional history of the lead aircraft. From the received information, and from the positional history, the trailing aircraft 160 may then calculate the closest previous position of the lead aircraft (shown at 150A) to the current position of the trailing aircraft 160 and then may provide to an output device information indicia of the leading aircraft relative to the trailing aircraft, and the differential flight parameter for the trailing aircraft. The differential flight parameter may comprise any information that may assist pilots with wake situational awareness, such as a location of the lead aircraft; identifying information of the lead aircraft; an altitude of the lead aircraft; weight information of the lead aircraft; airspeed information of the lead aircraft; a time value when the flight information transmission was transmitted; heading information of the lead aircraft; control surface configuration information of the lead aircraft; a rate of climb or descent of the lead aircraft; and weight-based class of the lead aircraft. Such information may be presented to an output device 109 such as display 110, as further described in regards to FIGS. 7 through 10. In various embodiments, a range of location histories 162 may be used to restrict the collection and creation of the positional history of the lead aircraft to reflect any desired range; for example, only positional values of the lead aircraft 150 may be stored when the lead aircraft's 150 prior positions (150A-C) are within a predetermined distance of the current aircraft 160, or when the previous the lead aircraft's 150 prior positions (150A-C) reflect transmissions from the lead aircraft 150 within a predetermined time window.

Figure 6:
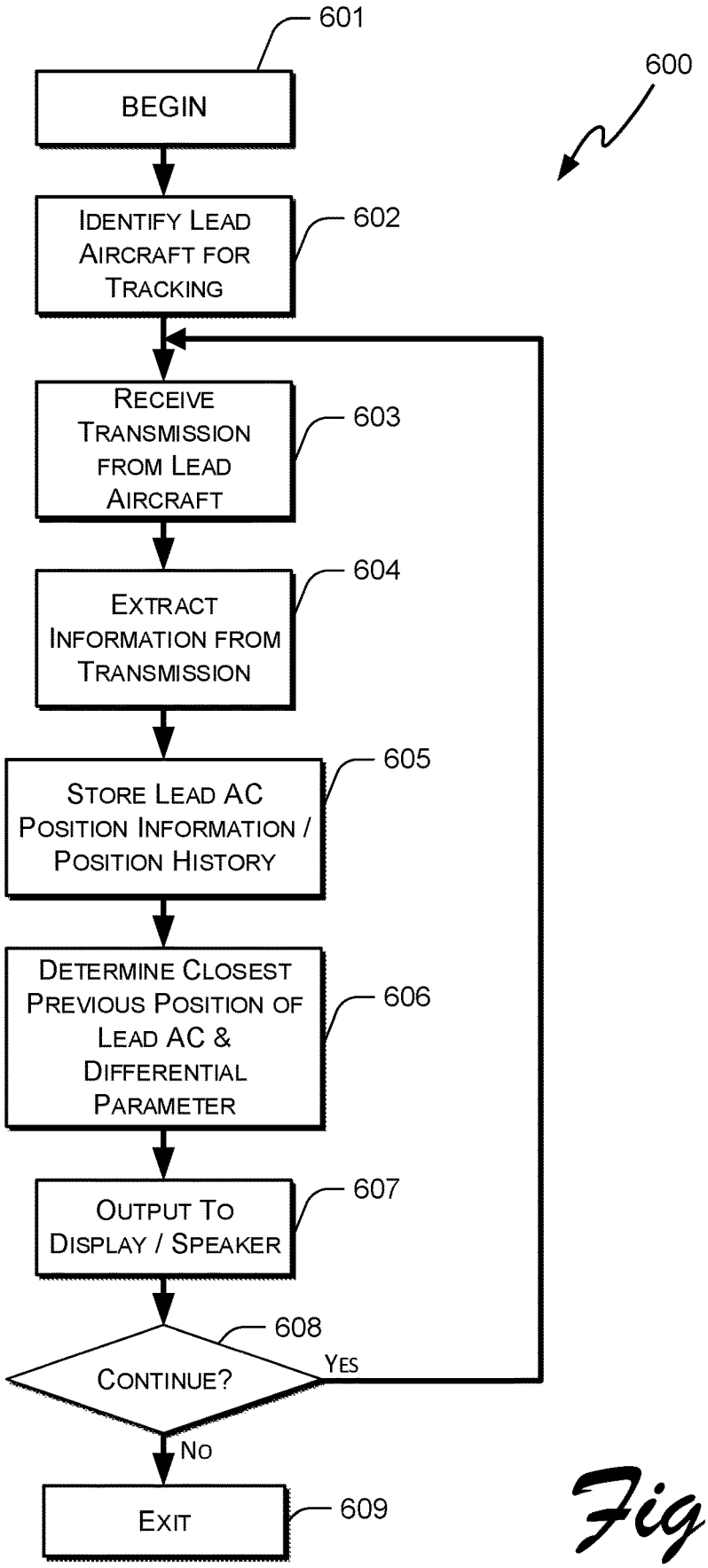
FIG. 6 depicts a flow chart of an embodiment of the present invention.

FIG. 6 illustrates a process flow 600 of an embodiment of the present invention. The process begins with identification 602 of a lead aircraft for tracking. Such indications may be made manually by a pilot, through an automated approach to identify the aircraft that most closely approximates the flight plan of the current aircraft, a paired aircraft indication provided air traffic control, or any other approach. As part of the identification process, a transmission may be received from an aircraft of interest that provides its identifying information and location, and the information may be decoded and utilized by embodiments of the present invention to identify the aircraft of interest a the lead aircraft. After a lead aircraft is identified, a transmission from the lead aircraft is received 603 by the trailing aircraft, and subsequently, information is decoded/demodulated/extracted 604 from the transmission and then position information regarding the lead aircraft is stored 605; further, from the plurality of stored position information, a positional history of the lead aircraft is created/updated. From the positional history, a closest previous position of the lead aircraft to the trailing aircraft's current location is computed 606 (for example through geometric approaches finding distance between the current trailing aircraft location and the lead aircraft locations in the positional history, then finding the minimum value). Once the closest previous stored position of the lead aircraft is determined, a differential flight parameter may be calculated, which in a preferred embodiment is a difference in altitude between the trailing aircraft's current position and the closest previous position of the lead aircraft. The differential parameter may, however, be computed to provide many types of information that may be helpful in wake turbulence situational awareness, such as flight path of the lead aircraft, relative flight path of the trailing aircraft, heading, distance between the lead aircraft and the trailing aircraft, ground speed of the lead aircraft, difference in ground speed between the lead aircraft and the trailing aircraft, or any other desired information. Once computed, the differential parameter, along with other information as described below, may be output 607 to an output device in a cockpit of the trailing aircraft such as a display or speaker, thus allowing the crew of the trailing aircraft to have an enhanced situational awareness for conditions that may lead to wake hazard events.

The process then iterates 608 to receive another transmission 603, from the lead aircraft, and positional history and differential parameters are updated for each transmission as flight progresses. Once the flight has been completed, or at any other desired time, the process terminates 609.

Figure 7:
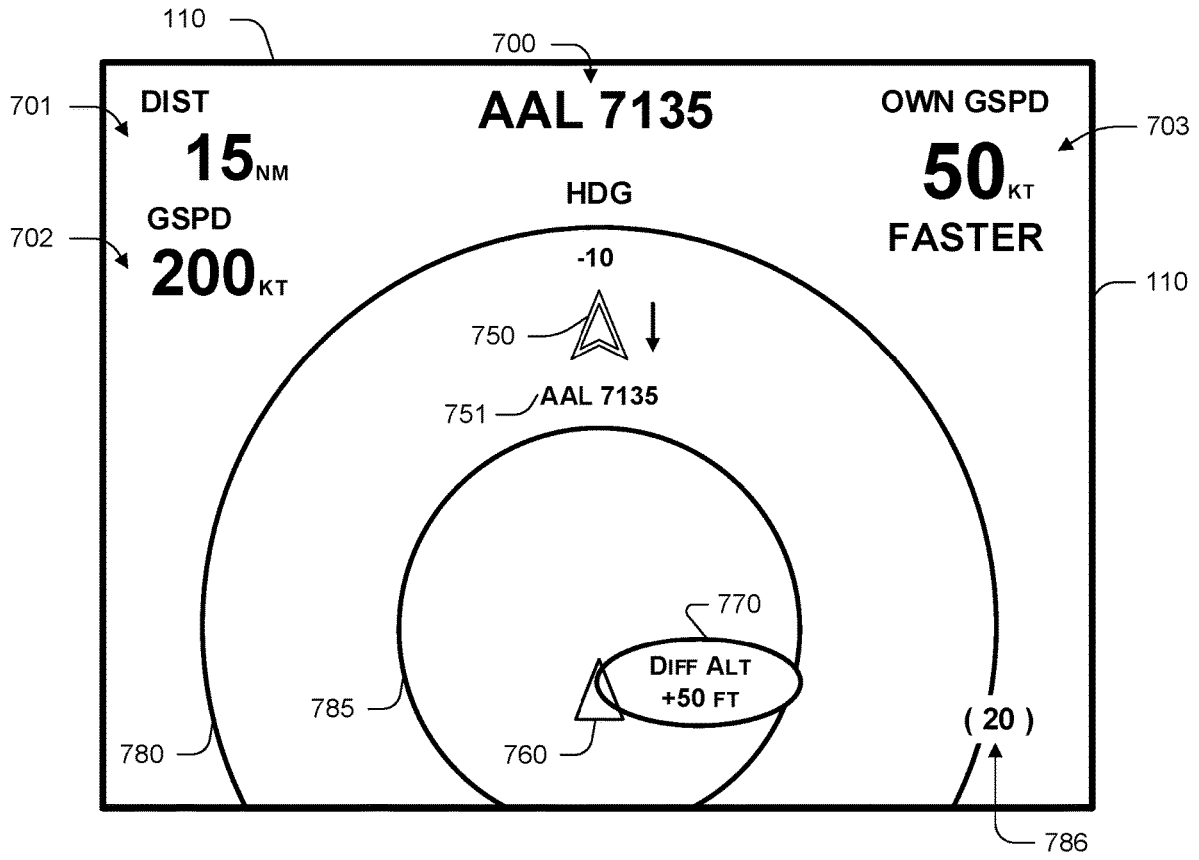
FIGS. 7-10 illustrate exemplary display layouts of embodiments of the present invention.

FIG. 7 illustrates one embodiment of a display 110 of the present invention, configured to display a bird's-eye view of lead 750 and trailing 760 aircraft information to enhance wake situational awareness in a cockpit of a trailing aircraft 760. The display 100 illustrates the trailing aircraft 760 (also "ownship" from perspective of the pilots viewing the display) in relative position to an identified leading aircraft 750. A flight identification indicator 751 is illustrated proximate to the lead aircraft 760, and for convenience, may also be reproduced at another area such at the top area 700 of the display 110. The relative distance 701 between the lead and trailing aircraft is presented, as well as the ground speed 702 of the lead aircraft and a differential traffic ground speed 703 between the lead aircraft 750 and the trailing aircraft 760 (in the illustrated example, the trailing aircraft 760 ("ownship") is moving 50 knots faster than the lead aircraft). Also provided on the display are range indicators 780, 785, along with a scale 786 to provide pilots with a visual understanding of relative distances on the display (here, "20" may indicate 20 nautical mile radius of the referenced range indicator). Also shown on the display 110 is a differential parameter 770 that shows the altitude difference between the current position of the trailing aircraft, and the closest historical location of the lead aircraft; here, for example, when the lead aircraft 750 was previously closest in position to the trailing aircraft's current location 760, the difference in altitude between the two positions is 50 feet, with the "+" sign indicating the trailing aircraft 760 is above the previous closest position of the lead aircraft 750.

Figure 8:
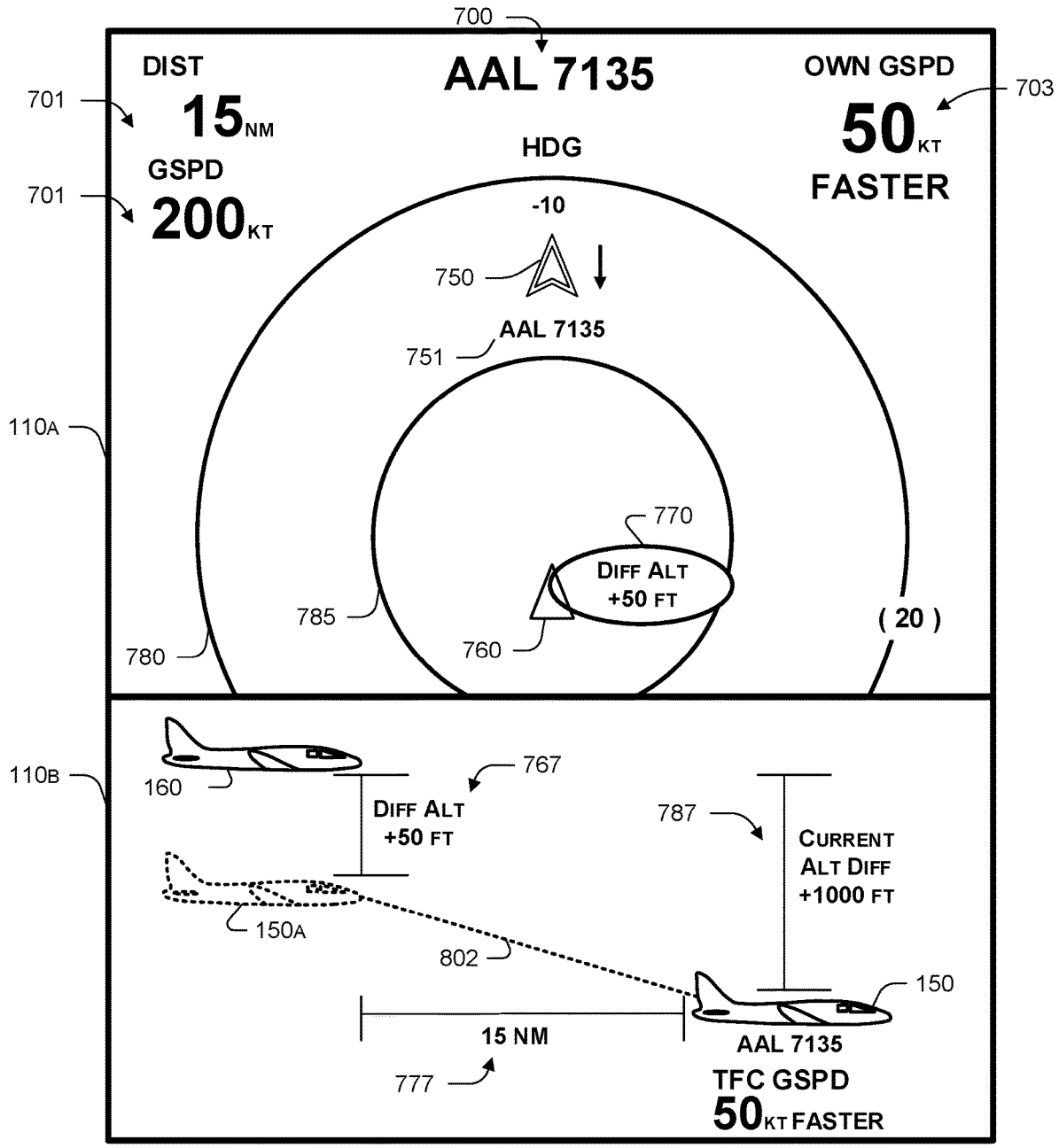
Figure 9:
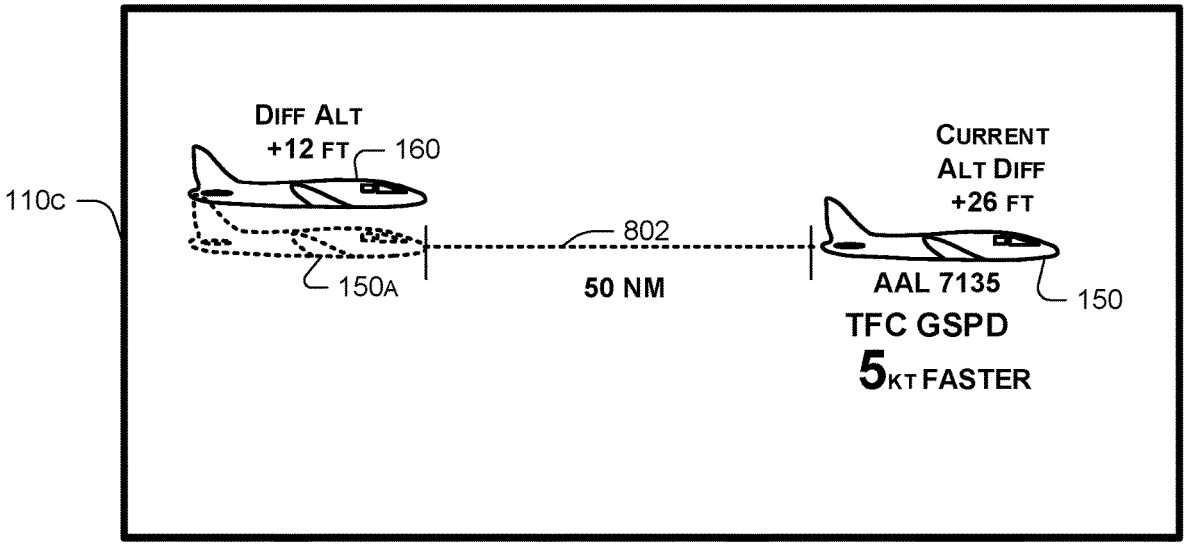
Figure 10:
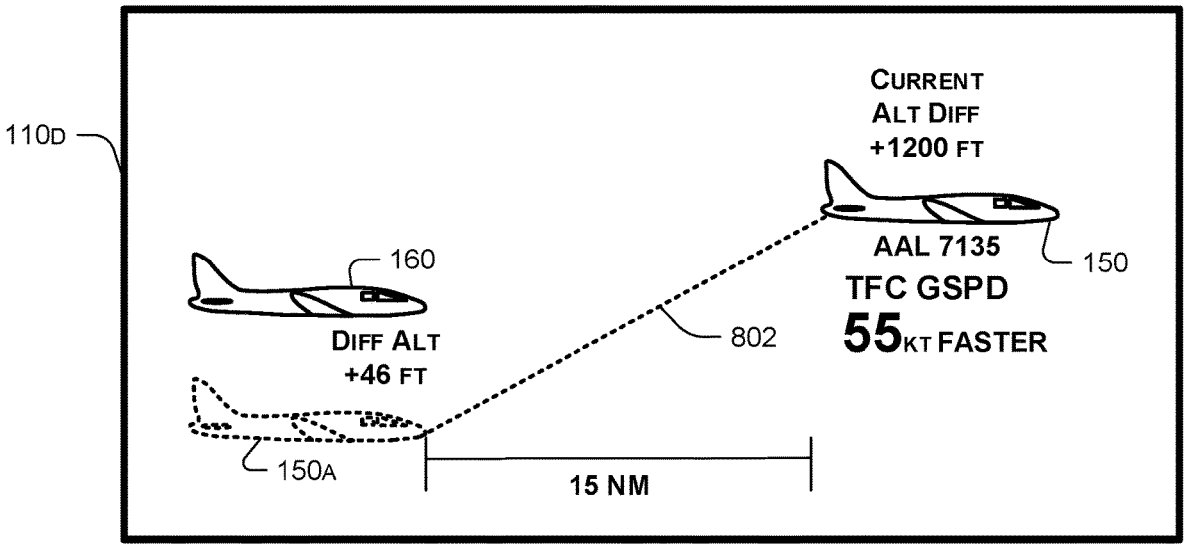

FIG. 8 shows a composite display of two display sections 110A and 110B; each individual section may be presented as shown in juxtaposition, or the sections 110A, 110B may be combined, or each display may be used separately or interchangeably. In an embodiment, bird's eye view 110A may reflects the same flight conditions as the side view display 110B, and each display provides a unique perspective of each approach. Regarding the side-view perspective shown in display section 110B, a trailing aircraft 160 is shown in relative position (from the positional history) to a lead aircraft 150, with the closest previous position 150A of the lead aircraft 150 displayed proximate to the trailing aircraft 150. Differential parameters are also shown, such as the difference in altitude 767 between the trailing aircraft's current location and the closest previously stored location 150A of the lead aircraft 150. A line or other indicia 802 may be provided to show relative altitude position between the closest previous position 150A of the lead aircraft 150, and the current location of the lead aircraft 150. Additionally, a differential altitude 787 may be provided that illustrates the relative differences between the current altitude of the trailing aircraft 160 and the current position of the lead aircraft 150. Relative speed information is also shown below the lead aircraft 150, but any other desired information may be provided on the display. Further relative distance 777 between the current position of each aircraft 160, 150 may be shown, or a time of flight between the current positions of the lead and following aircraft may be displayed (not shown). FIGS. 9 and 10 provide alternative illustrations showing optional positions of the aircraft with respect to relative altitude. Such situations may be used, for example for an en flight scenario (FIG. 9) or a rotation/takeoff/climb scenario (FIG. 10).

The particular implementations shown and described above are illustrative of the invention and its best mode and are not intended to otherwise limit the scope of the present invention in any way. Indeed, for the sake of brevity, conventional data storage, data transmission, and other functional aspects of the systems may not be described in detail. Methods illustrated in the various figures may include more, fewer, or other steps. Additionally, steps may be performed in any suitable order without departing from the scope of the invention. Furthermore, the connecting lines shown in the various figures are intended to represent exemplary functional relationships and/or physical couplings between the various elements. Many alternative or additional functional relationships or physical connections may be present in a practical system.

Changes and modifications may be made to the disclosed embodiments without departing from the scope of the present invention. These and other changes or modifications are intended to be included within the scope of the present invention, as expressed in the following claims.

What is claimed is:

1. A method comprising:

receiving, by a trailing aircraft, a plurality of flight information transmissions from a lead aircraft;

creating, from the plurality of flight information transmissions, a positional history of the lead aircraft;

determining from the positional history and the plurality of flight information transmissions, a differential flight parameter proximate a current position of the trailing aircraft; and presenting on a display in a cockpit of the trailing aircraft an indicia of the current position of the trailing aircraft, an indicia of the leading aircraft relative to the trailing aircraft, and the differential flight parameter for the trailing aircraft.

2. The method of claim 1, wherein each of the flight information transmissions comprises at least one of:

a location of the lead aircraft;

identifying information of the lead aircraft;

an altitude of the lead aircraft;

weight information of the lead aircraft;

airspeed information of the lead aircraft;

a time value when the flight information transmission was transmitted;

heading information of the lead aircraft;

control surface configuration information of the lead aircraft;

a rate of climb or descent of the lead aircraft;

weather information proximate to the lead aircraft; and weight-based class of the lead aircraft.

3. The method of claim 2, wherein the weight information of the lead aircraft comprises at one of: Super, Heavy, B757, Large, Small+, and Small.

4. The method of claim 2, wherein determining a differential flight parameter from the positional history and the plurality of flight information transmissions further comprises:

analyzing the positional history to determine a closest previous location of the lead aircraft based upon minimum distance to the current position of the trailing aircraft; and computing the differential flight parameter from a difference between an altitude of the lead aircraft at the closest previous location and a current altitude of the trailing aircraft.

5. The method of claim 4, further comprising:

determining whether the differential flight parameter is less than a minimum altitude separation distance.

6. The method of claim 5, wherein the minimum altitude separation distance is one of 1000 feet or 800 feet.

7. The method of claim 5, wherein the minimum altitude separation distance is in the range of 10 feet to 100 feet.

8. The method of claim 4, further comprising computing the differential flight parameter based upon computing a wake clearance margin utilizing;

the weight information of the lead aircraft;

the airspeed information of the lead aircraft; and an elapsed time from the time the closest previous location of the lead aircraft was transmitted to a current time.

9. The method of claim 4, further comprising computing the differential flight parameter based upon computing a wake clearance margin utilizing;

the weight information of the lead aircraft;

the airspeed information of the lead aircraft; and an extrapolated flight time to a current position of the lead aircraft.

10. The method of claim 4, further comprising computing the differential flight parameter based upon computing a wake clearance margin utilizing;

the weight information of the lead aircraft;

the airspeed information of the lead aircraft; and an expected sink rate of wake vortices generated by the lead aircraft.

11. The method of claim 4, further comprising computing the differential flight parameter is based upon computing a wake clearance margin utilizing;

the weight information of the lead aircraft;

the airspeed information of the lead aircraft; and a windspeed value and wind direction value proximate to the trailing aircraft; and an elapsed time from the time the closest previous location of the lead aircraft was transmitted to a current time.

12. The method of claim 1, wherein the flight information transmissions comprise Automatic Dependent Surveillance-Broadcast (ADS-B) transmissions.

13. The method of claim 1, wherein the flight information transmissions comprise messages overlaid onto an Air Traffic Control (ATC) signal via phase enhancement.

14. The method of claim 1, further comprising presenting on the display at least one of:

a location of the lead aircraft relative to the trailing aircraft;

a difference in altitude between a current position of the trailing aircraft and a closest position of the lead aircraft obtained from the flight information transmissions;

time and distance to the lead aircraft;

a differential flight parameter;

a flight path of the lead aircraft relative to a flight path of the trailing aircraft;

an alert for a potential wake turbulence event;

a guidance path for the trailing aircraft to avoid wake turbulence from the lead aircraft;

identifying information of the lead aircraft;

an altitude of the lead aircraft;

weight information of the lead aircraft;

airspeed information of the lead aircraft;

a time value when the flight information transmission was transmitted;

heading information of the lead aircraft;

control surface configuration information of the lead aircraft;

a rate of climb or descent of the lead aircraft; and weight-based class of the lead aircraft.

15. The method of claim 1, further comprising:

identifying a plurality of threat aircraft;

computing a respective differential flight parameter for each of the threat aircraft; and rendering on the display an indicia of each of the plurality of threat aircraft relative to the position of the trailing aircraft, and associated with each of the respective indicia, the respective differential flight parameter.

16. The method of claim 1, further comprising producing, in a cockpit of the trailing aircraft, an aural announcement that the trailing aircraft is at risk of encountering a wake turbulence event from the lead aircraft.

17. The method of claim 1, wherein the positional history of the lead aircraft is restricted to a predetermined time window.

18. The method of claim 1, wherein the differential flight parameter further comprises one of a flight path of the lead aircraft; relative flight path of the trailing aircraft, heading; distance between the lead aircraft and the trailing aircraft, ground speed of the lead aircraft; and difference in ground speed between the lead aircraft and the trailing aircraft.

19. A system in a trailing aircraft comprising:
a processor electrically coupled to a memory,
a transceiver electrically coupled to the processor;
an output device in the cockpit of the trailing aircraft including a display electrically coupled to the processor;
a position measuring device coupled to the processor; and
an antenna coupled to the transceiver;
whereby the memory is configured to store code that when executed by the processor, performs the steps of:
receiving, by the transceiver, a plurality of flight information transmissions from a lead aircraft and storing the transmissions in the memory;
creating, from the plurality of flight information transmissions, a positional history of the lead aircraft, and storing the positional history of the lead aircraft in the memory;
determining from the positional history and the plurality of flight information transmissions, a differential flight parameter proximate a current position of the trailing aircraft; and
presenting on the display an indicia of the current position of the trailing aircraft, an indicia of the leading aircraft relative to the trailing aircraft, and the differential flight parameter for the trailing aircraft.

20. The system of claim 19, wherein each of the flight information transmissions comprises at least one of:
a location of the lead aircraft;
identifying information of the lead aircraft;
an altitude of the lead aircraft;
weight information of the lead aircraft;
airspeed information of the lead aircraft;
a time value when the flight information transmission was transmitted;
heading information of the lead aircraft;
control surface configuration information of the lead aircraft;
a rate of climb or descent of the lead aircraft; and
weather information proximate to the lead aircraft; and
weight-based class of the lead aircraft.

21. The system of claim 20, wherein the weight information of the lead aircraft comprises at one of: Super, Heavy, B757, Large, Small+, and Small.

22. The system of claim 20, wherein determining a differential flight parameter from the positional history and the plurality of flight information transmissions further comprises:
analyzing the positional history to determine a closest previous location of the lead aircraft based upon minimum distance to the current position of the trailing aircraft; and
computing the differential flight parameter from a difference between an altitude of the lead aircraft at the closest previous location and a current altitude of the trailing aircraft.

23. The system of claim 22, further comprising:
determining whether the differential flight parameter is less than a minimum altitude separation distance.

24. The system of claim 23, wherein the minimum altitude separation distance is one of 1000 feet or 800 feet.

25. The system of claim 23, wherein the minimum altitude separation distance is in the range of 10 feet to 100 feet.

26. The system of claim 22, further comprising computing the differential flight parameter based upon computing a wake clearance margin utilizing:
the weight information of the lead aircraft;
the airspeed information of the lead aircraft; and
an elapsed time from the time the closest previous location of the lead aircraft was transmitted to a current time.

27. The system of claim 22, further comprising computing the differential flight parameter based upon computing a wake clearance margin utilizing:
the weight information of the lead aircraft;
the airspeed information of the lead aircraft; and
an extrapolated flight time to a current position of the lead aircraft.

28. The system of claim 22, further comprising computing the differential flight parameter based upon computing a wake clearance margin utilizing:
the weight information of the lead aircraft;
the airspeed information of the lead aircraft; and
an expected sink rate of wake vortices generated by the lead aircraft.

29. The system of claim 22, further comprising computing the differential flight parameter is based upon computing a wake clearance margin utilizing;
the weight information of the lead aircraft;
the airspeed information of the lead aircraft; and
a wind speed value and wind direction value proximate to the trailing aircraft; and
an elapsed time from the time the closest previous location of the lead aircraft was transmitted to a current time.

30. The system of claim 19, wherein the flight information transmissions comprise ADS-B transmissions.

31. The system of claim 19, wherein the flight information transmissions comprise messages overlaid onto an ATC signal via phase enhancement.

32. The system of claim 19, further comprising presenting on the display at least one of:
a location of the lead aircraft relative to the trailing aircraft;
a difference in altitude between a current position of the trailing aircraft and a closest position of the lead aircraft obtained from the flight information transmissions;
time and distance to the lead aircraft;
a flight path of the lead aircraft relative to a flight path of the trailing aircraft;
an alert for a potential wake turbulence event;
a differential flight parameter;
a guidance path for the trailing aircraft to avoid wake turbulence from the lead aircraft;
identifying information of the lead aircraft;
an altitude of the lead aircraft;
weight information of the lead aircraft;
airspeed information of the lead aircraft;

a time value when the flight information transmission was transmitted;

heading information of the lead aircraft;

control surface configuration information of the lead aircraft;

a rate of climb or descent of the lead aircraft; and weight-based class of the lead aircraft.

33. The system of claim 19, further comprising:

identifying a plurality of threat aircraft;

computing a respective differential flight parameter for each of the threat aircraft; and rendering on the display an indicia of each of the plurality of threat aircraft relative to the position of the trailing aircraft, and associated with each of the respective indicia, the respective differential flight parameter.

34. The system of claim 19, further comprising producing, in a speaker electrically coupled to the output device, an aural announcement that the trailing aircraft is at risk of encountering a wake turbulence event from the lead aircraft.

35. The system of claim 19, wherein the positional history of the lead aircraft is restricted to a predetermined time window.

* * * * *